US008447053B2

(12) United States Patent
Tseng et al.

(10) Patent No.: US 8,447,053 B2
(45) Date of Patent: May 21, 2013

(54) FLAT SPEAKER APPARATUS WITH HEAT DISSIPATING STRUCTURE AND METHOD FOR HEAT DISSIPATION OF FLAT SPEAKER

(75) Inventors: Kuo-Hua Tseng, Taipei County (TW); Chang-Ho Liou, Changhua County (TW); Ming-Daw Chen, Hsinchu (TW); Kuan-Wei Chen, Taichung County (TW)

(73) Assignee: Industrial Technology Research Institute, Hsinchu (TW)

( * ) Notice: Subject to any disclaimer, the term of this patent is extended or adjusted under 35 U.S.C. 154(b) by 303 days.

(21) Appl. No.: 12/821,150

(22) Filed: Jun. 23, 2010

(65) Prior Publication Data

US 2011/0216921 A1 Sep. 8, 2011

(30) Foreign Application Priority Data

Mar. 8, 2010 (TW) ..... 99106607 A

(51) Int. Cl.
*H04R 25/00* (2006.01)
*H04R 1/00* (2006.01)

(52) U.S. Cl.
USPC ..... 381/164; 381/150; 381/191; 381/431

(58) Field of Classification Search ..... 381/164, 381/150, 191, 431
See application file for complete search history.

(56) References Cited

U.S. PATENT DOCUMENTS

| | | | | |
|---|---|---|---|---|
| 5,297,214 | A * | 3/1994 | Bruney | 381/431 |
| 6,215,884 | B1 * | 4/2001 | Parrella et al. | 381/190 |
| 2007/0025588 | A1 * | 2/2007 | Bachmann et al. | 381/431 |
| 2008/0212805 | A1 * | 9/2008 | Fincham | 381/160 |
| 2009/0016551 | A1 * | 1/2009 | Chiang et al. | 381/191 |
| 2009/0060234 | A1 * | 3/2009 | Liou et al. | 381/191 |
| 2009/0067648 | A1 * | 3/2009 | Liou et al. | 381/191 |
| 2010/0024198 | A1 * | 2/2010 | Chen et al. | 29/594 |
| 2010/0027814 | A1 * | 2/2010 | Chen et al. | 381/150 |
| 2010/0034402 | A1 * | 2/2010 | Lin et al. | 381/150 |
| 2010/0104116 | A1 * | 4/2010 | Liou et al. | 381/191 |
| 2010/0158284 | A1 * | 6/2010 | Lin et al. | 381/191 |
| 2010/0166230 | A1 * | 7/2010 | Tseng et al. | 381/150 |
| 2010/0208932 | A1 * | 8/2010 | Liou et al. | 381/387 |
| 2010/0260370 | A1 * | 10/2010 | Chen et al. | 381/386 |
| 2011/0033079 | A1 * | 2/2011 | Liou et al. | 381/431 |
| 2011/0146056 | A1 * | 6/2011 | Liou et al. | 29/592.1 |

FOREIGN PATENT DOCUMENTS

EP 2071870 A2 * 6/2009

* cited by examiner

*Primary Examiner* — David Warren
*Assistant Examiner* — Christina Russell
(74) *Attorney, Agent, or Firm* — Jianq Chyun IP Office

(57) ABSTRACT

A flat speaker apparatus including a driving circuit module, a flat speaker and a thermally conductive connector, and with a heat dissipating structure is introduced. The flat speaker includes a porous electrode and a vibrating film. The porous electrode causes the vibrating film to vibrate according to an audio signal output from the driving circuit module for generating sound. The thermally conductive connector connects the driving circuit module and the flat speaker to conduct heat from the driving module to the flat speaker for dissipation. A method for heat dissipation of the flat speaker is also introduced herein.

17 Claims, 7 Drawing Sheets

FLAT SPEAKER APPARATUS WITH HEAT DISSIPATING STRUCTURE AND METHOD FOR HEAT DISSIPATION OF FLAT SPEAKER

CROSS-REFERENCE TO RELATED APPLICATION

This application claims the priority benefit of Taiwan application serial no. 99106607, filed on Mar. 8, 2010. The entirety of the above-mentioned patent application is hereby incorporated by reference herein and made a part of specification.

BACKGROUND OF THE INVENTION

1. Technical Field

The disclosure relates to a flat speaker apparatus with a heat dissipating structure and a heat dissipation method adopting the same.

2. Background

Vision and hearing are two humanity's most direct sensory responses. Therefore, scientists have been dedicated to develop various renewable visual and auditory related systems. Regarding the speakers, moving coil speakers dominate the entire market. In recent years, with people's increasing demands for sensing quality, and development trends of 3C products (computer, communication, consumer electronics) for lightness, slimness, shortness and smallness, a power-saving, light and slim speaker designed according to an ergonomic requirement is developed. Such speaker can be used in either large-size flat speakers or small walkman headphones and stereo mobile phones, and in a foreseeable future, such technology has large demand and application development.

Electroacoustic speakers are mainly grouped into direct and indirect radiation speakers, and the speakers are approximately grouped into moving coil, piezoelectric and electrostatic speakers according to driving methods thereof. The moving coil speaker is currently the most commonly used and most mature product. However, a moving coil speaker cannot be compressed due to the physical structure thereof. Accordingly, moving coil speaker is not suitable for 3C products and home entertainment systems which have their sizes reduced constantly.

In the piezoelectric speaker, an electric field is applied to the piezoelectric material to cause deformation according to a piezoelectric effect of a piezoelectric material, so as to drive a vibrating membrane to generate sound. Although such speaker has a flat and miniaturized structure, the sound quality thereof is limited.

Main products of the electrostatic speaker in the market include hi-end earphones and loudspeakers. A functional principle of the conventional electrostatic speaker is to use two fixed porous electrode plates to clamp a conductive vibrating membrane to form a capacitor, and by supplying a direct current (DC) bias to the vibrating membrane and supplying an alternating current (AC) voltage to the two fixed electrodes, the conductive vibrating membrane is vibrated due to an electrostatic force generated under a positive and a negative electric fields, so as to radiate a sound. The bias of the conventional electrostatic speaker has to reach hundreds to thousands voltages, so that an external amplifier with a high price and a great size has to be applied, and therefore application thereof cannot be widespread.

In addition, according to the conventional techniques, during a mass production, speaker units have to be produced individually, and the speaker generally has a fixed size or shape, so that effective mass production and cost reduction cannot be achieved, and features of softness, thinness, low driving voltage and flexibility of the speaker cannot be achieved.

Moreover, driving circuit modules of the moving coil, piezoelectric, or electrostatic speakers all have large volume and heavy weight, and usually occupy certain amount of space and weight. The volumes and weight mostly come from heat dissipating structures of the driving circuit modules.

Since the flat speaker requires a high voltage, high current, and high power driving method to achieve larger volume and better frequency response curve, electronic devices within the driving circuit module then eventually generate high heat. In order to prevent high heat, temperature sensors, heat sinks, and fans are conventionally adopted for heat dissipation so as to ensure the proper functioning of the system. However, lightness, softness, thinness, flexibility, and low driving voltage are the major requirements of flat speakers, and the disposition of temperature sensors, heat sinks, and fans is contrary to these requirements. Furthermore, fans generate interfering current and noise, thereby affecting the operation of flat speakers and the sound quality perceived by the user. Additionally, about 35% of the circuit board space and 20% of the component costs can be saved if the heat sinks, the temperature sensors, controllers, and enabling switches are removed effectively.

SUMMARY

The disclosure provides a flat speaker apparatus with a heat dissipating structure. In this flat speaker apparatus, a thermally conductive connector conducts the heat energy generated by electrically components of a driving circuit module to an electrode of a flat speaker. When the speaker is turned on, a mechanism generated by propelling air with a vibrating film allows the heat on a porous electrode to be dissipated to outside through a sound hole of the porous electrode while the flat speaker is producing sound. In the above heat dissipation mechanism, additional heat dissipating devices such as fans, heat sinks, temperature sensors, and enabling switches are not required for heat dissipation. At the same time, the flexible speaker and the driving circuit module are further integrated into a single unit.

Additionally, the disclosure provides a method of heat dissipation of a flat speaker. A flat speaker device at least includes a driving circuit module and a flat speaker. The flat speaker at least includes a porous electrode and a vibrating film. The method of heat dissipation of the speaker includes steps as follow. A heat conductive path is established between the driving circuit module and the flat speaker. When the driving circuit module drives the flat speaker, the porous electrode and the vibrating film interact with each other for the vibrating film to propel air so as to generate sound. Moreover, the heat energy generated by electrical components of the driving circuit module is dissipated through the flat speaker and a metal structure thereof by air convection.

In order to make the aforementioned and other features of the disclosures more comprehensible, several exemplary embodiments accompanied with figures are described in detail below.

BRIEF DESCRIPTION OF THE DRAWINGS

The accompanying drawings are included to provide a further understanding of the exemplary embodiment, and are incorporated in and constitute a part of this specification. The drawings illustrate exemplary embodiments and, together with the description, serve to explain the principles of the exemplary embodiment.

DESCRIPTION OF DISCLOSED EMBODIMENTS

Figure 1:
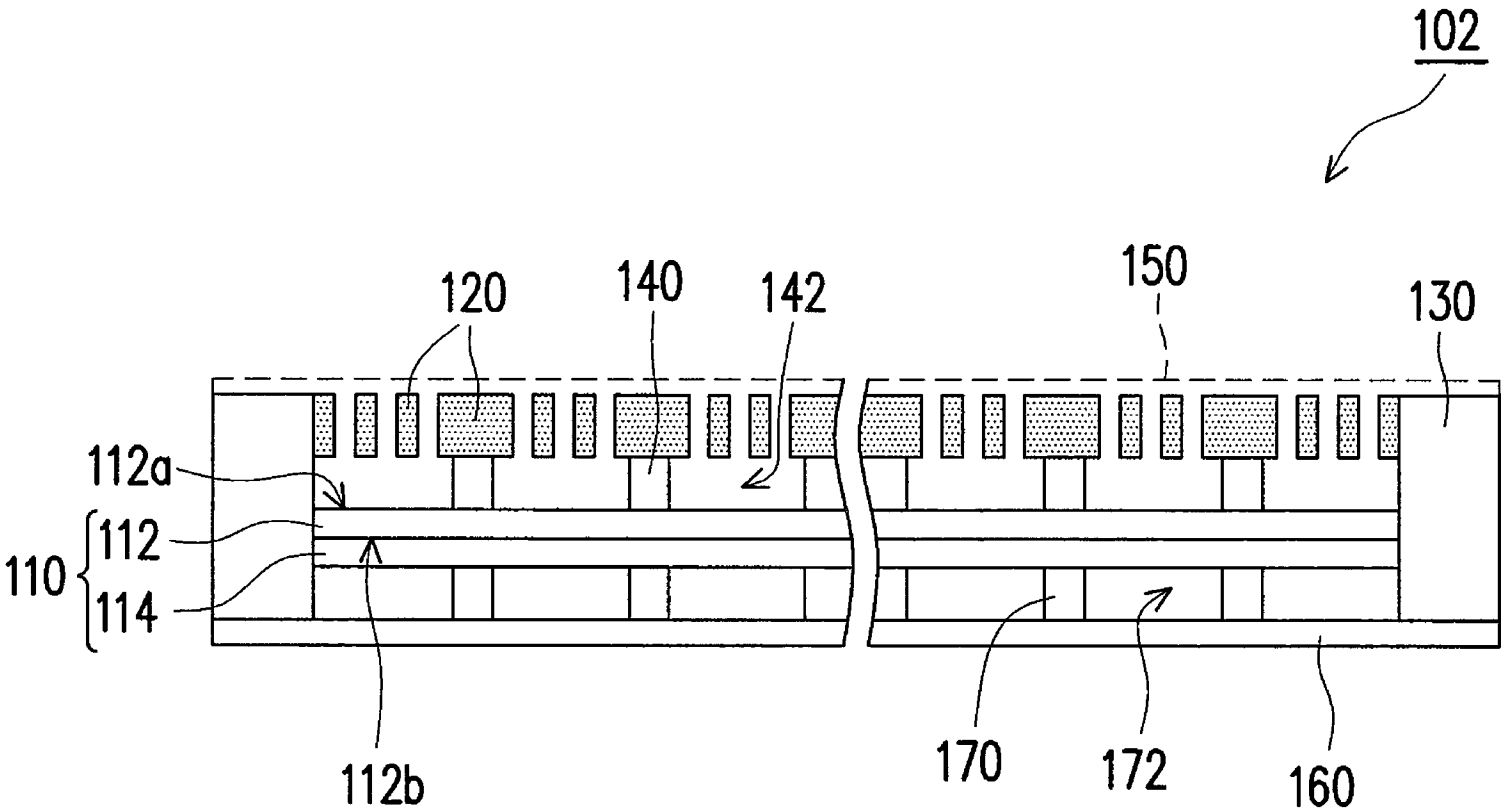
FIG. 1 is a schematic cross-sectional view illustrating a flat speaker according to an exemplary embodiment of the disclosure.

In a disclosure, a flat speaker apparatus including a driving circuit module, a flat speaker, and a thermally conductive connector is provided. Herein, the thermally conductive connector is connected to the driving circuit and the flat speaker so as to conduct the heat generated by the driving circuit module to a metal structure, for example, a porous electrode, inside the flat speaker.

According to the disclosure, the flat speaker includes a porous electrode and a vibrating film. The vibrating film includes an electret layer and a conductive electrode. The porous electrode and the vibrating film are suitable of interacting with each other according to an audio signal output from the driving circuit module, such that the vibrating film vibrates to generate a corresponding sound.

According to the disclosure, the flat speaker further includes a supporting member disposed between the electrode and the vibrating film, where the supporting member is a ringed geometric structure.

According to the disclosure, the thermally conductive connector connects to the porous electrode of the flat speaker.

According to the disclosure, the flat speaker further includes a frame supporting member. The frame supporting member fixes the porous electrode and the vibrating film on two opposite sides. Moreover, the thermally conductive connector connects to the frame supporting member of the flat speaker so as to generate air convection through the vibration of the vibrating film for heat dissipation.

According to the disclosure, the flat speaker further includes a sound cavity substrate disposed on one side of the vibrating film facing away from the electrode. The thermally conductive connector connects to the sound cavity substrate of the flat speaker so as to generate air convection through the vibration of the vibrating film for heat dissipation. That is, the vibrating film and the porous electrode form a heat spreader jointly.

According to the disclosure, the thermally conductive connector is sandwiched between the porous electrode and the sound cavity substrate so as to generate air convection through the vibration of the vibrating film for heat dissipation.

According to the disclosure, the flat speaker further includes another porous electrode disposed on one side of the vibrating film facing away from the electrode.

According to the disclosure, the thermally conductive connector is sandwiched between the porous electrode and the another porous electrode so as to generate air convection through the vibration of the vibrating film for heat dissipation.

According to the disclosure, the porous electrode, the frame supporting member, the sound cavity substrate, and/or another porous electrode are fabricated using thermal conductive metal materials, non-metallic materials, or flexible materials.

According to the disclosure, the driving circuit module is a printed circuit board, an integrated circuit, or a flexible circuit board.

According to the disclosure, the driving circuit module includes a flat speaker driving circuit, a power module, and a wireless transmission module.

According to the disclosure, the wireless transmission module is a Bluetooth wireless transmission module, a WIFI wireless transmission module, or a wireless transmission technique of other types.

Additionally, in another disclosure, the disclosure provides a method of heat dissipation of a flat speaker and the method is suitable for a flat speaker apparatus. Here, a flat speaker device at least includes a driving circuit module and a flat speaker. The flat speaker at least includes a porous electrode and a vibrating film. The method of heat dissipation of the speaker includes steps as follow. A heat conductive path is established between the driving circuit module and the flat speaker. When the driving circuit module drives the flat speaker, the porous electrode and the vibrating film interact with each other for the vibrating film to propel air so as to generate sound. Moreover, the heat energy generated by electrical components of the driving circuit module is dissipated through the flat speaker and a metal structure thereof by air convection.

According to the disclosure, the heat conductive path is established between the driving circuit module, heat dissipating devices and the vibrating film of the flat speaker for heat conductive connection.

According to the disclosure, the heat conductive path is established between the driving circuit module and the porous electrode of the flat speaker for heat conductive connection.

According to the disclosure, the heat conductive path is established between the driving circuit module and the frame supporting member of the flat speaker for heat conductive connection. Herein, the frame supporting member is configured to fix the porous electrode and the vibrating film on two opposite sides.

Referring to FIG. 1, FIG. 1 is a schematic cross-sectional view illustrating a flat speaker according to an exemplary embodiment of the disclosure.

A speaker 102 may have several active regions for a vibrating film 110 located between any two adjacent supporting members. The two sides of the membrane 110 may have its active regions defined in the same way or defined differently. A sound cavity structure illustrated includes two cavity spaces for generating resonance sound field or effect of the speaker. Here, one of the cavity spaces is located above the vibrating film 110 and the other one is located below the same. The speaker 102 has a plurality of supporting members designed to have specific shapes and placements within an upper and a lower cavity spaces. In an exemplary embodiment, the upper cavity space in FIG. 1 is a soniferous hole region and the lower cavity space opposite to the soniferous hole region in FIG. 1 is a sound cavity structure 172. The space of the lower cavity located between a sound cavity substrate 160 and the vibrating film 110 produces the resonance sound field of the speaker 102 using a plurality of active regions of the vibrating film located between any two adjacent sound cavity supporting members.

The speaker unit 102 includes the vibrating film 110, a porous electrode 120, a frame supporting member 130, and a plurality of supporting members 140 between the electrode 120 and the vibrating film 110. The sound cavity structure 172 enclosed or partially enclosed by the sound cavity substrate 160 and a plurality of supporting members 170 located between the vibrating film 110 and the sound cavity substrate 160 is disposed on one side of the vibrating film 110 opposite to the electrode 120. The sound cavity substrate 160, the supporting members 170, and the sound cavity structure 172 surrounded are optional. That is, the speaker structure can omit the sound cavity substrate 160, the supporting members 170, and the sound cavity structure 172. In addition, the sound cavity substrate 160 can be replaced by another porous electrode. In other words, the speaker 102 has two pieces of porous electrodes located on two sides of the vibrating film 110 respectively.

The vibrating film 110 includes an electret layer 112 and a metallic thin film electrode 114. In some exemplary embodiments, an upper surface 112*a* of the electret layer 112 is electrically coupled to the frame supporting member 130 and the supporting members 140. On the other hand, a bottom surface 112*b* of the electret layer 112 is electrically coupled to the metallic thin film electrode 114. An insulation layer (not shown) is sandwiched between the electret layer 112 and the electrode 114.

The porous electrode 120 is made of, for example, metal. In an exemplary embodiment, the porous electrode 120 is fabricated by plating a metallic thin film on paper or an extremely thin, non-conductive material.

When the porous electrode 120 is formed by plating the metallic thin film on the layer of the non-conductive material, the non-conductive material can be plastic, rubber, paper, non-conductive cloth (cotton fibers or polymeric fibers) or other non-conductive materials. Moreover, the metallic thin film can be aluminum, gold, silver, copper, nickel/gold bimetals, indium tin oxide (ITO), indium zinc oxide (IZO), macromolecule conductive materials such as polyethylenedioxythiophene (PEDOT), and so on; an alloy, or any combination of the listed material or equivalents thereof. When the porous electrode 120 includes a conductive material, the conductive material may be metal (iron, copper, aluminum or alloys thereof), conductive cloth (metallic fibers, metal oxide fibers, carbon fibers or graphite fibers), and so on, or any combination of these materials or other materials.

The electret layer 112 is formed using a dielectric material which can be treated or electrified to allow it to keep static charges for a period of time or an extended period of time. Moreover, the electret layer 112 has a ferroelectric or static effect within the material after being charged. The electret layer 112 has one or multiple dielectric layers. The dielectric material includes, for example, fluorinated hylenepropylene (FEP), polytetrafluoethylene (PTFE), polyvinylidene fluoride (PVDF), fluorinated polymer, or other suitable materials. The dielectric material includes pores of micrometer scale or nanometer scale. Since the electret layer 112 is capable of keeping static charges for an extended period of time and has the piezoelectric characteristics after subject to an electrifying treatment, the pores within the vibrating film can increase transmission and enhance piezoelectric characteristics of this material. In an exemplary embodiment, after corona charging, dipolar charges are produced and kept within the dielectric material to produce the ferroelectric effect or the static effect.

To provide good tension and/or vibration effects of the vibrating film 110, the metallic thin film 114 is a thin metallic electrode. For example, the thickness thereof ranges from 0.2 micrometer (μm) to 0.8 μm or from 0.2 μm to 0.4 μm. In some exemplary embodiments, the thickness is about 0.3 μm. The scale range illustrated is usually identified as "ultra-thin".

Taking the electret layer 112 carrying negative charges as an example, when an input audio signal is supplied to the porous electrode 120 and the metallic thin film electrode 114, a positive voltage of the input signal produces an attracting force on the negative charges of the vibrating film and a negative voltage of the input signal produces a repulsive force on the negative charges of this unit, such that the vibrating film 110 moves toward one direction. In contrast, when the voltage phase of the input audio signal is changed, a positive voltage similarly produces an attracting force on the negative charges of the vibrating film 110, and a negative voltage produces a repulsive force on the negative charges of this unit, so that the vibrating film 110 moves toward a direction opposite to the foregoing direction. The vibrating film moves back-and-forth repetitively and vibrates to compress the surrounding air to produce sound through the interaction of different forces in different directions. In other words, the porous electrode and the vibrating film interact with each other according to the audio signal, so that the vibrating film vibrates to produce a corresponding sound.

In an exemplary embodiment, a film 150 covers one side or both sides of the speaker 102. The film 150 is air-permeable but water-proof, and is made of, for example, a GORE-TEX® thin film containing expanded polytetrafluoroethylene (ePTFE). GORE-TEX® or similar materials prevent influence of water and oxygen, thereby preventing the electret layer 112 from losing its charges and having its ferroelectric effect reduced.

A plurality of active regions of the vibrating film 110 is formed between any two adjacent supporting members 140 and between the above-mentioned porous electrode 120 and the vibrating film 110. The active regions of the upper cavity 142 are configured to produce a resonance sound field of the speaker 102. The active regions of the vibrating film 110 are formed between any two adjacent supporting members 170 and between the sound cavity substrate 160 and the vibrating film 110. The active regions of the bottom cavity 172 are configured to produce a resonance sound field of the speaker 102. Both the supporting members 140 and the supporting members 170 may be adjusted, as part of the speaker design, in their placements in the chambers, their heights, and their shapes. In addition, the number of the supporting members 170 can be greater than, equal to or less than the number of the supporting members 140, and the supporting members 140 or the supporting members 170 can be fabricated directly on or over the porous electrode 120 or the sound cavity substrate 160. The sound cavity structure is close to the surface of the metallic thin film electrode 114 of the vibrating film 110 and may be designed by considering the audio-frequency characteristic of the speaker or other acoustic or structural factors. The sound cavities include a sound-absorbing material and the supporting members or the sound cavity supporting members can be designed in various shapes. The cavity space formed by the frame supporting member 130 has a sound hole in the frame supporting member 130 for releasing the pressure of produced sound and, in some instances, creating a better sound field effect. The driving circuit module supplying voltage to the porous electrode 120 is independent from the flat speaker 102 and electrically connected thereto. Accordingly, the overall weight and volume of the driving circuit module of heat dissipating devices and the flat speaker 102 cannot be minimized. Accordingly, the disclosure provides a flat speaker apparatus integrating the flat speaker and the driving circuit module and omitting the heat dissipating devices in the driving circuit module so as to reduce the overall weight and volume. The exemplary embodiment shown in this figure has two cavities. However, the disclosure can also have a single cavity; that is, the cavity 172 is removed.

Figure 2:
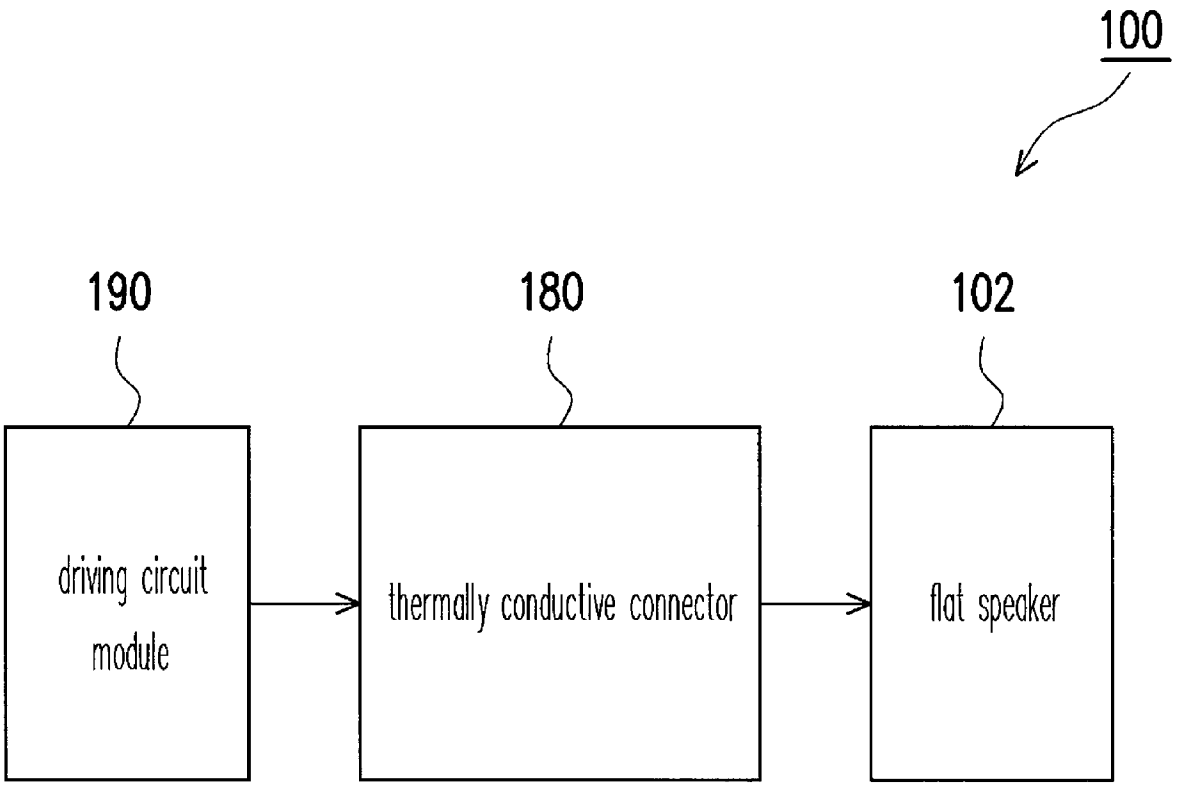
FIG. 2 is a schematic block diagram illustrating a flat speaker apparatus according to an exemplary embodiment of the disclosure.

Referring to FIG. 2, FIG. 2 is a schematic block diagram illustrating a flat speaker apparatus according to an exemplary embodiment of the disclosure. According to the exemplary embodiment, a flat speaker apparatus 100 includes the aforementioned flat speaker 102, a driving circuit module 190, and a thermally conductive connector 180. Here, arrows in FIG. 2 represent the direction of thermal conduction. That is, the thermally conductive connector 180 can conduct the heat generated by the driving circuit module 190 to a metal structure within the flat speaker 102 so as to dissipate heat therethrough. The thermally conductive connector 180 is fabricated using a thermally conductive material. The thermally conductive material and thermal conductivity defined herein are illustrated with a material having a thermally conductivity coefficient larger than 0.5 Watt/Meter×Kelven (W/m×K) and the capability of this material. According to an exemplary embodiment of the disclosure, the thermal conductivity coefficient of the thermally conductive connector 180 is larger than 10 W/m×K. According to another exemplary embodiment of the disclosure, the thermal conductivity coefficient of the thermally conductive connector 180 is larger than 100 W/m×K. Moreover, the thermally conductive connector 180 can have a random structure. For example, the thermally conductive connector 180 can have a screw structure, a thermal grease structure, a heat sink structure, or any structure capable of thermal conduction.

For the heat of the driving circuit module 190 to be conducted to the thermally conductive connector 180 and the flat speaker 102 easily, an area of a contact surface of the driving circuit module 190 and the thermally conductive connector 180 is 25% larger than an area of the driving circuit module 190. According to an exemplary embodiment of the disclosure, the area of this contact surface is larger than the area of the driving circuit module 190 by 50%. According to another exemplary embodiment of the disclosure, the area of this contact surface is larger than the area of the driving circuit module 190 by 75%.

Figure 3:
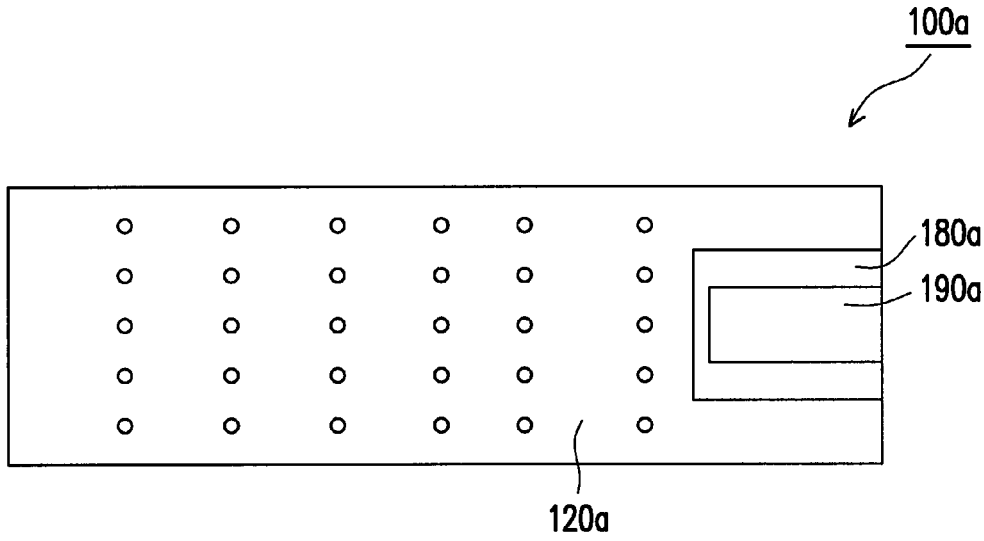
FIG. 3 is a schematic top view illustrating a flat speaker apparatus according to an exemplary embodiment of the disclosure.

Referring to FIG. 3, FIG. 3 is a schematic top view illustrating a flat speaker apparatus according to an exemplary embodiment of the disclosure. According to this embodiment, a driving circuit module 190*a* of a flat speaker apparatus 100*a* is connected to a porous electrode 120*a* of the flat speaker through a thermally conductive connector 180*a*. Thus, the heat generated by electrical components within the driving circuit module 190*a* can be conducted to a metal structure within the flat speaker through the thermally conductive connector 180*a* for heat dissipation. Here, the metal structure is, for example, the porous electrode 120*a* or other metal structures. After the heat is conducted to the porous electrode 120*a*, the air convection generated when the vibrating film propels air for the flat speaker to produce a sound allows heat dissipation while the speaker is producing a sound.

According to the exemplary embodiment, the thermally conductive connector 180*a* is connected to the porous electrode 120*a*. However, the disclosure is not limited thereto. The thermally conductive connector 180*a* can also be connected to other components of the flat speaker, for example, the frame supporting members or the sound cavity substrate, so as to generate air convection through the vibration of the vibrating film for heat dissipation.

Figure 4:
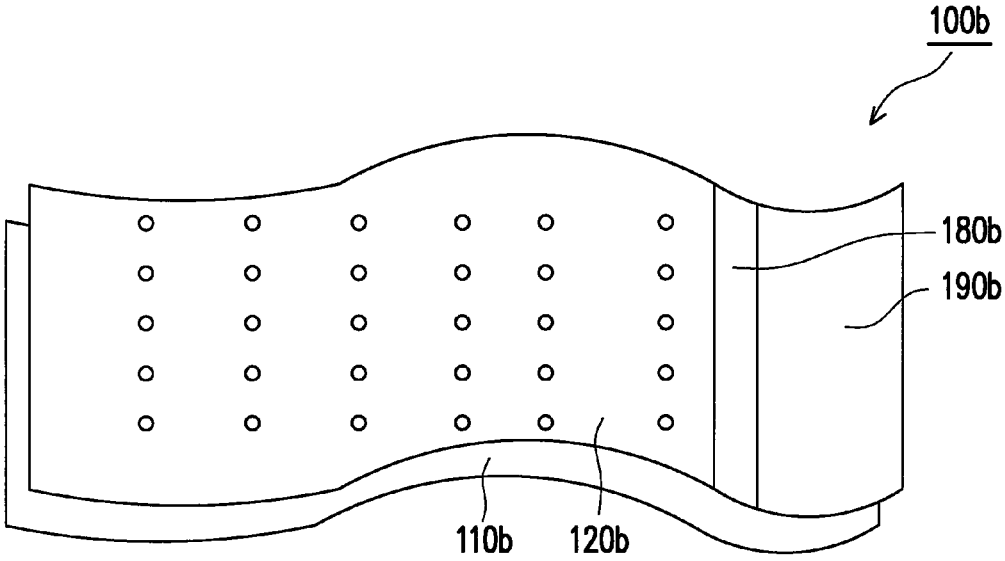
FIG. 4 is a schematic top view illustrating a flat speaker apparatus according to an exemplary embodiment of the disclosure.

The placements of the driving circuit module and the thermally conductive connector of the disclosure is not only suitable for rigid thin flat speaker, but also suitable for flexible thin flat speaker. FIG. 4 is a schematic top view illustrating a flat speaker apparatus according to an exemplary embodiment of the disclosure. According to this exemplary embodiment, a driving circuit module 190*b* of a flat speaker apparatus 100*b* is connected to one side of the flat speaker through a thermally conductive connector 180*b*. Herein, the porous electrode 120*b*, the frame supporting member, and the sound cavity substrate are fabricated using not only metal materials, but also with non-metal materials or flexible materials with conductivity. The flat speaker device 100*b* can therefore be flexible. According to the placements above-mentioned, the heat generated by electrical components within the driving circuit module 190*b* can be conducted to a metal structure of the flat speaker through the thermally conductive connector 180*b*. Thereafter, the heat is dissipated through the porous electrode 120*b* or other metal components of the flat speaker. After the heat is conducted to the porous electrode 120*b*, the air convection generated when the vibrating film 110*b* propels air for the flat speaker to produce a sound is utilized, such that a surface, a sound hole or the periphery of the sound hole of the porous electrode 120*b* can undergo heat exchange with the external environment so as to dissipate the heat while the speaker is producing a sound.

According to the exemplary embodiment, the thermally conductive connector 180*b* is connected to the porous electrode 120*b*. However, the disclosure is not limited thereto. The thermally conductive connector 180*b* can also be connected to other components of the flat speaker, for example, the frame supporting members or the sound cavity substrate.

Figure 5:
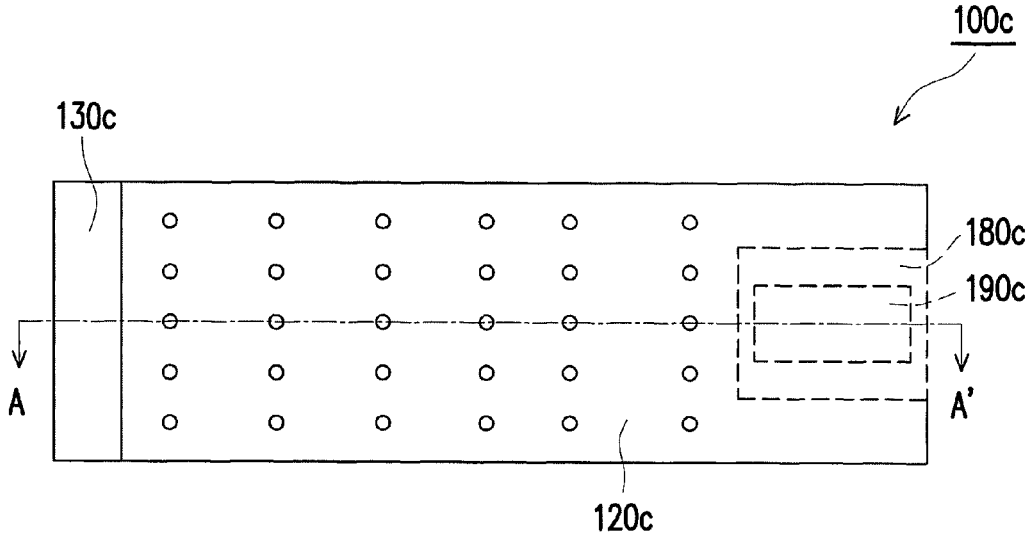
FIG. 5 is a schematic top view illustrating a flat speaker apparatus according to an exemplary embodiment of the disclosure.
Figure 6:
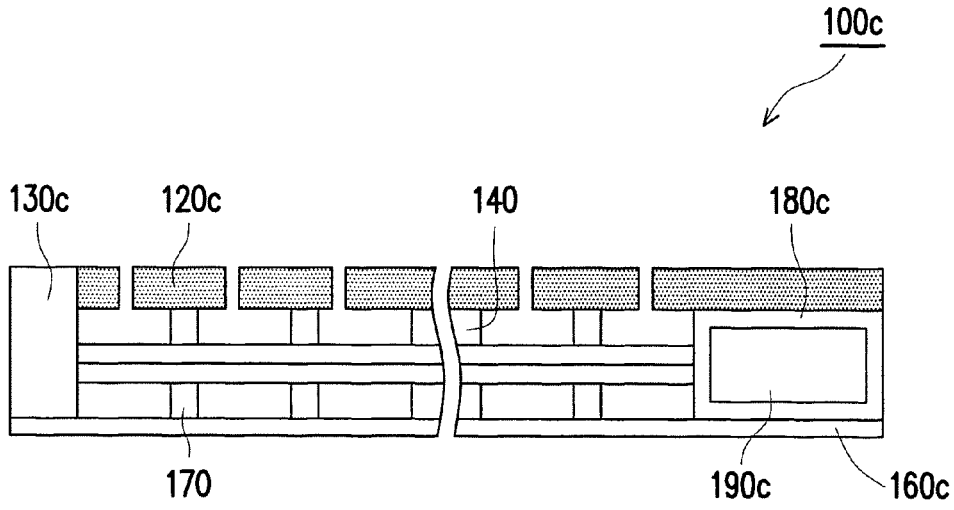
FIG. 6 is a schematic cross-sectional view taken along line A-A' in FIG. 5.

Moreover, the driving circuit module and the thermally conductive connector are not only disposed above, below or on the side of the flat speaker, but can also be disposed within the flat speaker, as shown in FIGS. 5 and 6. FIG. 5 is a schematic top view illustrating a flat speaker apparatus according to an exemplary embodiment of the disclosure. FIG. 6 is a schematic cross-sectional view taken along line A-A' in FIG. 5.

Referring to FIGS. 5 and 6 simultaneously, according to the exemplary embodiment, a driving circuit module 190*c* of a flat speaker apparatus 100*c* is sandwiched between the porous electrode 120*c* and a sound cavity substrate 160*c* by heat connection through the thermally conductive connector 180*c*. Herein, the porous electrode 120*c*, a frame supporting member 130*c*, and the sound cavity substrate 160*c* are fabricated using not only metal materials, but also with non-metal materials or flexible materials with conductivity. According to the placements above-mentioned, the heat generated by electrical components within the driving circuit module 190*c* can be conducted to the porous electrode 120*c* and the sound cavity substrate 160*c* of the flat speaker through the thermally conductive connector 180*c*. After the heat is conducted to the porous electrode 120*c*, the air convection generated when the vibrating film propels air for the flat speaker to produce a sound can dissipate the heat while the speaker produces a sound.

In this exemplary embodiment, the thermally conductive connector 180*c* is connected to the porous electrode 120*c* and the sound cavity 160*c*. However, the disclosure is not limited thereto. The thermally conductive connector 180*c* can be connected to other components of the flat speaker, for example, the frame supporting member 130*c*. When the sound cavity substrate 160*c* is replaced by another porous electrode, then the driving circuit module 190*c* and the thermally conductive connector 180*c* is sandwiched between two porous electrodes so as to generate air convection for heat dissipation.

In this exemplary embodiment, the driving circuit module 190*c* and the thermal conductive connector 180*c* are disposed on one side of the flat speaker apparatus 100*c*; however, the disclosure is not limited thereto. The driving circuit module 190*c* and the thermally conductive connector 180*c* may also be disposed in the center or other regions of the flat speaker apparatus 100*c*.

Figure 7A:
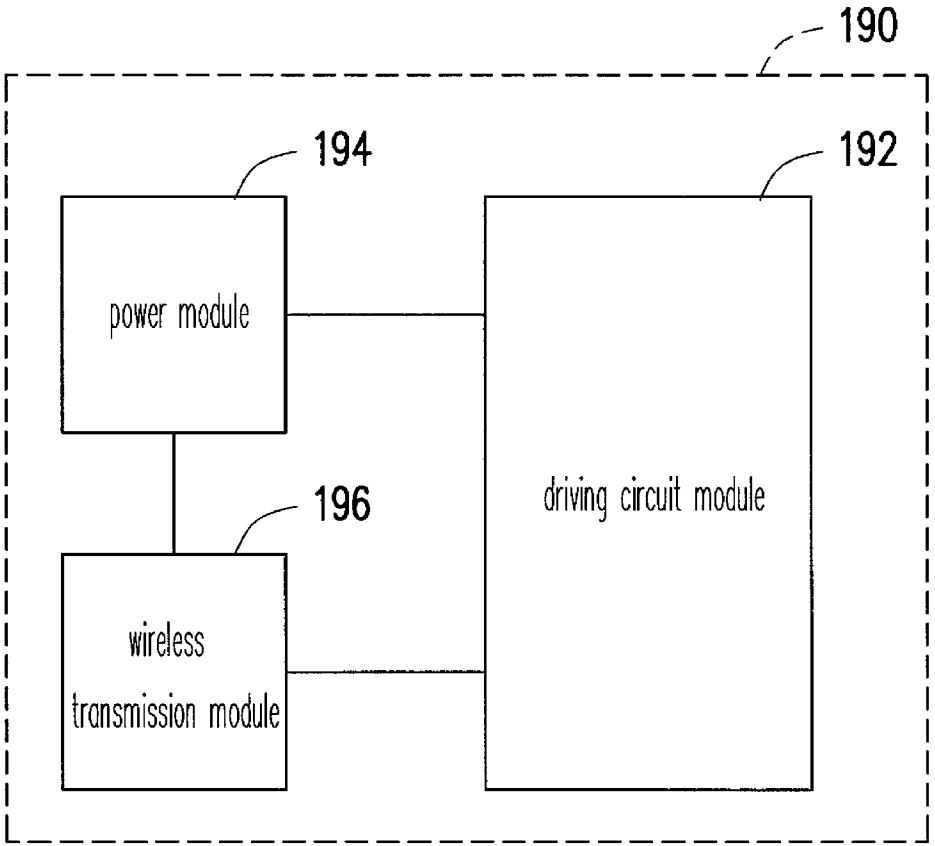
FIGS. 7A-7C are schematic block diagrams of a driving circuit module according to an exemplary embodiment of the disclosure.

The flat speaker apparatuses in the foregoing embodiments receives audio signals and operation instructions through wire connection or wireless connection. For instance, the driving circuit module 190 in FIG. 7A not only includes a driving circuit module 192 and a power module 194, but further includes a wireless transmission module 196 such as Bluetooth wireless transmission module, WIFI wireless transmission module, or other types of operation techniques with wireless transmission functions. Therefore, a user is capable of playing music anywhere he/she wants using electronic products with wireless transmission functions such as cellular phones, personal computers, or digital walkman, to achieve application modes that cannot be accomplished by conventional stereo systems.

Figure 7B:
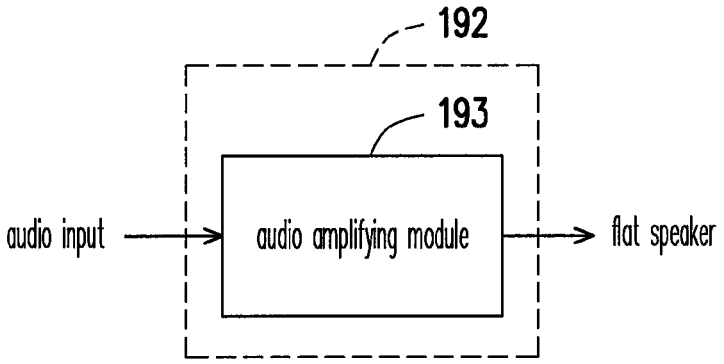
Figure 7C:
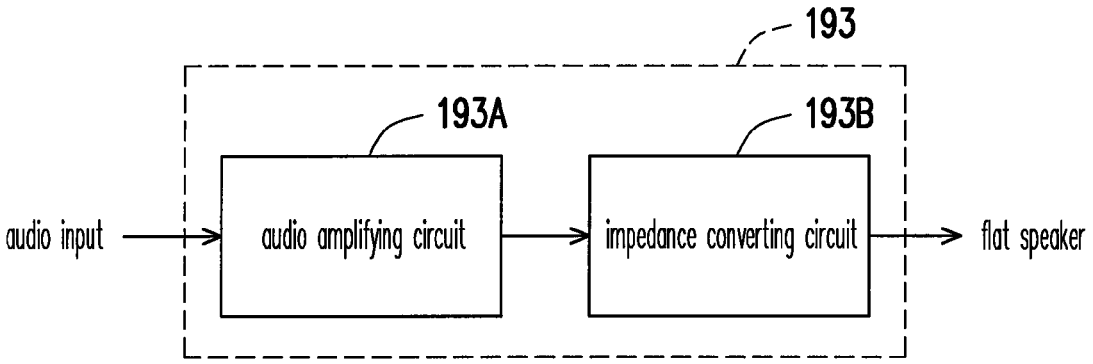

As shown in FIG. 7B, in an exemplary embodiment, the driving circuit module 192 of the flat speaker includes an audio amplifying module 193 which is configured to receive an audio signal. After being amplified, the audio signal is transmitted to a metal structure within the flat speaker through the heat conducting framework of the exemplary embodiment. In addition, as shown in FIG. 7C, in an exemplary embodiment, the audio amplifying module 193 at least includes an audio amplifying circuit 193A or at least includes one of an audio amplifying circuit 193A and an impedance converting circuit 193B. The impedance converting circuit 193B is constituted by at least one adaptor.

Further, the disclosure provides a method of heat dissipation of a speaker suitable for a flat speaker apparatus. Here, a flat speaker apparatus at least includes a driving circuit module and a flat speaker. The flat speaker at least includes a porous electrode and a vibrating film. The method of heat dissipation of the speaker includes steps shown below. A heat conductive path is established between the driving circuit module and the flat speaker. When the driving circuit module drives the flat speaker, the porous electrode and the vibrating film interact with each other for the vibrating film to propel air so as to generate sound. Moreover, the heat energy generated by electrical components of the driving circuit module is dissipated through the flat speaker and a metal structure thereof by air convection. That is, the vibrating film and the porous electrode form a heat spreader jointly.

Here, the heat conductive path established between the driving circuit module and the flat speaker directly or indirectly allows the heat energy generated by the electrical components of the driving circuit module to be conducted to the metal structure of the flat speaker. For example, an area of a contact surface of the driving circuit module and the flat speaker, or an area of a contact surface of the driving circuit module and the thermally conductive connector located between the driving circuit module and the flat speaker is 25% larger than the area of the driving circuit module. According to an embodiment of the disclosure, the individual area of these contact surfaces is larger than the area of the driving circuit module by 50%. According to another embodiment of the disclosure, the individual area of these contact surfaces is larger than the area of the driving circuit module by 75%. The method of connecting the driving circuit module and the flat speaker is referred as heat conductive connection.

According to an exemplary embodiment, the heat conductive path is established between the driving circuit module, heat dissipating devices and the vibrating film of the flat speaker for heat conductive connection.

According to an exemplary embodiment, the heat conductive path is established between the driving circuit module and the porous electrode of the flat speaker for heat conductive connection.

According to an exemplary embodiment, the heat conductive path is established between the driving circuit module and the frame supporting member of the flat speaker for heat conductive connection. Herein, the frame supporting member is configured to fix the porous electrode and the vibrating film on two opposite sides.

Figure 8:
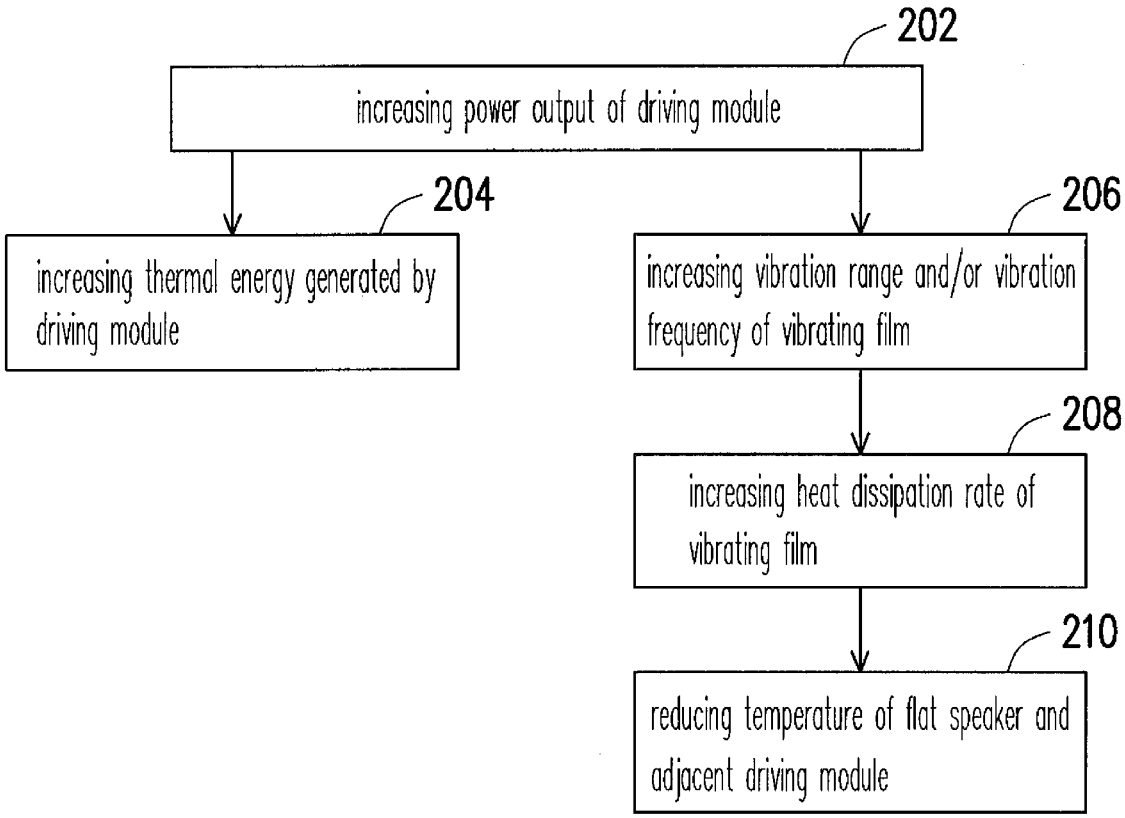
FIG. 8 is a method of heat dissipation according an exemplary embodiment of the disclosure.

Other than the heat dissipation method aforementioned, a method of adjusting rate of dissipation is also provided in the disclosure. Generally, temperature sensors are usually required for detecting dissipation rate of active dissipating devices (i.e. fans) according to the power output and the heat generated by the electrical components in the driving circuit module. As the power output gets higher, the heat generated by the electrical components of the driving circuit module also becomes higher. When excess heat is detected by the temperature sensors, the temperature sensors can output signal to the driving circuit module for the driving circuit module to increase the dissipation rate of the active dissipating devices. Nevertheless, according to an exemplary embodiment of the disclosure, the automatic feedback mechanism can also be achieved without applying any temperature sensors, current sensors, and voltage sensors. Referring to FIG. 8, FIG. 8 is a method of heat dissipation according an exemplary embodiment of the disclosure. An active heat dissipating device is a vibrating film which is also capable of producing sound in a flat speaker. Moreover, the driving circuit module and the flat speaker are independent from each other. Different from FIG. 2, arrows in FIG. 8 illustrate a flowchart of the steps instead of the direction of thermal conduction. As the driving circuit module increases its power output (step 202), the heat generated also gets higher (step 204), and the vibration range and/or vibration frequency of the vibrating film increase (step 206). Thus, the speed of air flow propelled by the vibrating film also increases so as to increase the dissipate rate (step 208) and decrease the temperature of the flat speaker and the adjacent driving circuit module (step 210). Here, the so-called heat dissipation rate is defined as the heat dissipating ability of the heat dissipating devices or the actual dissipation rate of thermal energy of the heat dissipating devices.

In summary, the flat speaker apparatus having the heat dissipating structure in the foregoing exemplary embodiments directly utilizes the air convection generated by the flat speaker when simultaneously producing sound so as to achieve heat dissipation. Accordingly, not only are the hardware space and manufacturing cost of the driving circuit module reduced, but the integration of the flat speaker and the driving circuit module is also facilitated to obtain a new product that is light, thin, and integrated.

Moreover, the audio signal can be transmitted to the flat speaker through cellular phones, personal digital assistants, or digital walkmans for play. Through this disclosure, the flat speaker can play a major role in the design of stereo systems in the future.

Although the disclosure has been described with reference to the above exemplary embodiments, it will be apparent to one of the ordinary skill in the art that modifications to the described exemplary embodiment may be made without departing from the spirit of the disclosure. Accordingly, the scope of the disclosure will be defined by the attached claims not by the above detailed descriptions.

What is claimed is:

1. A flat speaker apparatus with a heat dissipating structure, comprising:

a driving circuit module;

a flat speaker, comprising:

a porous electrode; and a vibrating film, wherein the porous electrode and the vibrating film interact with each other according to an audio signal output from the driving circuit module for the vibrating film to generate a corresponding sound;

a thermally conductive connector, connecting the driving circuit module and the flat speaker so as to conduct heat generated by the driving circuit module to the flat speaker, wherein the driving circuit module of the flat speaker at least comprises an audio amplifying module and an impedance converting circuit, wherein the impedance converting circuit comprises at least one adaptor.

2. The flat speaker apparatus with the heat dissipating structure as claimed in claim 1, wherein the flat speaker further comprises a supporting member disposed between the electrode and the vibrating film.

3. The flat speaker apparatus with the heat dissipating structure as claimed in claim 1, wherein the vibrating film comprises an electret layer and a conductive electrode layer.

4. The flat speaker apparatus with the heat dissipating structure as claimed in claim 1, wherein the thermally conductive connector is connected to the porous electrode of the flat speaker.

5. The flat speaker apparatus with the heat dissipating structure as claimed in claim 1, wherein the flat speaker further comprises a frame supporting member fixing the porous electrode and the vibrating film on two opposite sides.

6. The flat speaker apparatus with the heat dissipating structure as claimed in claim 5, wherein the thermally conductive connector is connected to the frame supporting member of the flat speaker.

7. The flat speaker apparatus with the heat dissipating structure as claimed in claim 1, wherein the flat speaker further comprises a sound cavity substrate disposed on one side of the vibrating film facing away from the electrode.

8. The flat speaker apparatus with the heat dissipating structure as claimed in claim 7, wherein the thermally conductive connector is connected to the sound cavity substrate of the flat speaker.

9. The flat speaker apparatus with the heat dissipating structure as claimed in claim 7, wherein the thermally conductive connector is sandwiched between the porous electrode and the sound cavity substrate.

10. The flat speaker apparatus with the heat dissipating structure as claimed in claim 1, further comprising another porous electrode disposed on one side of the vibrating film facing away from the electrode.

11. The flat speaker apparatus with the heat dissipating structure as claimed in claim 10, wherein the thermally conductive connector is sandwiched between the porous electrode and the another porous electrode.

12. The flat speaker apparatus with the heat dissipating structure as claimed in claim 1, wherein the driving circuit module further comprises a driving circuit module of the flat speaker, a power module, and a wireless transmission module.

13. A method of heat dissipation of a flat speaker apparatus as claimed in claim 1, the method comprising:

establishing a heat conductive path between the driving circuit module and the flat speaker of the flat speaker apparatus; and when the driving circuit module drives the flat speaker, generating sound by propelling air with the vibrating film through an interaction between the porous electrode and the vibrating film, and dissipating heat energy generated by electrical components of the driving circuit module through the flat speaker and metal structures thereof by air convection.

14. The method of heat dissipation of the flat speaker apparatus as claimed in claim 13, wherein the heat conductive path is established between the driving circuit module and the vibrating film of the flat speaker for heat conductive connection.

15. The method of heat dissipation of the flat speaker apparatus as claimed in claim 13, wherein the heat conductive path is established between the driving circuit module and the porous electrode of the flat speaker for heat conductive connection.

16. The method of heat dissipation of the flat speaker apparatus as claimed in claim 13, wherein the heat conductive path is established between the driving circuit module and a frame supporting member of the flat speaker for heat conductive connection, wherein the frame supporting member is configured for fixing the porous electrode and the vibrating film on two opposite sides.

17. A flat speaker apparatus with a heat dissipating structure, comprising:

a driving circuit module, comprising an audio amplifying module or constituted by an audio amplifying module and an impedance converting module, wherein the impedance converting module comprises one or more than one adaptor;

a flat speaker, comprising:

a porous electrode, a plurality of supporting structures, and a vibrating film, wherein the porous electrode and the vibrating film interact with each other according to an audio signal output from the driving circuit module for the vibrating film to generate a corresponding sound; and a thermally conductive connector, connecting the driving circuit module and the flat speaker.

* * * * *